US006772815B1

(12) United States Patent
Judkins

(10) Patent No.: US 6,772,815 B1
(45) Date of Patent: Aug. 10, 2004

(54) WINDOW COVERING HAVING FACES OF PARALLEL THREADS

(76) Inventor: Ren Judkins, 46 Newgate Rd., Pittsburgh, PA (US) 15202

( * ) Notice: Subject to any disclaimer, the term of this patent is extended or adjusted under 35 U.S.C. 154(b) by 0 days.

(21) Appl. No.: 10/364,153

(22) Filed: Feb. 11, 2003

(51) Int. Cl.[7] ..... E06B 3/48
(52) U.S. Cl. ..... 160/84.05; 160/89; 160/178.3
(58) Field of Search ..... 160/84.05, 84.04, 160/89, 178.3, 176.1 R, 177 R, 236, 121.1, 168.1, 166.1, 332, 108, 113, 114, 123; 442/203; 139/384 A; D6/575; 428/116

(56) References Cited

U.S. PATENT DOCUMENTS 1,492,544 A * 4/1924 Hough ..... 160/231.1
3,366,161 A * 1/1968 Barnett ..... 160/368.1
3,384,519 A 5/1968 Froget
3,490,515 A * 1/1970 Kandel ..... 160/178.1 R
3,851,699 A 12/1974 Shapiro
5,313,999 A 5/1994 Colson et al.
5,339,882 A 8/1994 Judkins
5,753,338 A 5/1998 Jelic et al.
5,806,579 A * 9/1998 Judkins ..... 160/168.1 R
6,164,363 A * 12/2000 Colson et al. ..... 160/84.05
6,484,786 B1 * 11/2002 Ruggles et al. ..... 160/84.05

* cited by examiner

*Primary Examiner*—Blair M. Johnson
(74) *Attorney, Agent, or Firm*—Buchanan Ingersoll, P.C.

(57) ABSTRACT

A light controllable window covering has a transparent front face and a transparent back face, either or both of which are formed from a series of spaced apart parallel threads, and a series of opaque slats attached between the two faces. The parallel threads which form the front face and back face are spaced apart an amount which allows light to readily pass while providing a soft fabric like appearance. The slats are preferably knitted or woven fabric treated to have a given light impeding property. The front and back longitudinal edges of each slat are respectively attached to the front face and the back face. The resulting structure when combined with a hardware system is a light control honeycomb window covering. Movement of the light impeding slats from a position perpendicular to the front face and back face to a position generally parallel to the front and back face controls the amount of light which is admitted through the window covering. An additional layer may be provided opposite the front face or the back face.

24 Claims, 5 Drawing Sheets

FIG.3
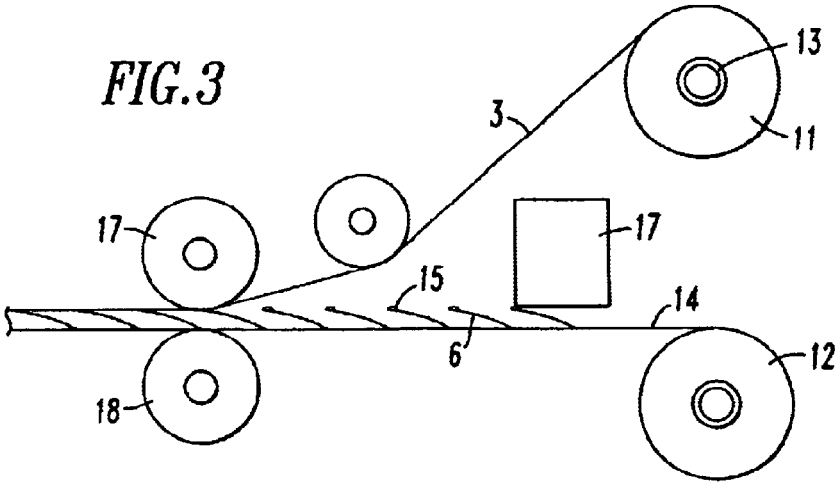
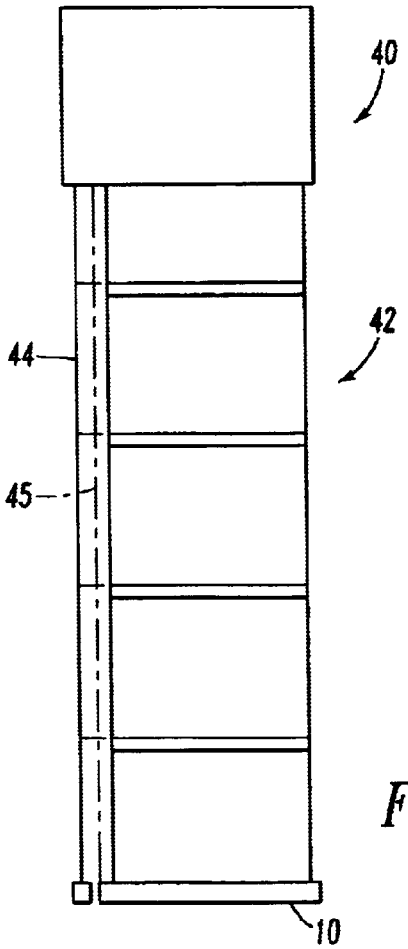
FIG.7

WINDOW COVERING HAVING FACES OF PARALLEL THREADS

FIELD OF INVENTION

The invention relates to window coverings and particularly to a window covering having a cellular structure with strips or slats connected between two parallel faces of material through which light may pass.

BACKGROUND OF THE PRIOR ART

Venetian blinds are well-known window coverings. They have a series of horizontal slats hung from ladders which extend between a top rail and a bottomrail. The slats can be rotated between an open, see through position and a closed position. Additionally, the blinds can be raised and lowered. Venetian blinds contain aluminum, plastic or wood slats and are available in a wide range of colors.

Fabric window coverings and draperies are often preferred by consumers over venetian blinds because they have a softer, warmer appearance. However, draperies do not have the ability to control the amount of light transmitted through the window covering in a manner similar to louvered blinds like the traditional venetian blind.

Several attempts have been made to provide a fabric window covering with the ability to control the amount of light entering the room. Shapiro in U.S. Pat. No. 3,851,699 discloses a window draw drape having spaced apart light impeding and light transmitting vertical sections. The light impeding sections can be rotated to cover all or portions of the light admitting sections. The light impeding sections are vertical slats attached to the drapery or tightly woven fabric. The light admitting sections are open mesh. This product is difficult to operate because the light impeding sections tend not to align with the light admitting portions when those sections are rotated.

In U.S. Pat. No. 5,313,999 to Colson et al. there is a window covering having first and second parallel sheer fabric sides and a plurality of light impeding or somewhat light impeding vanes extending between the sheer fabric sides. The vanes are angularly controllable by relative movement of the sheer fabric sides. Like the combination of a sheer fabric and a light impeding fabric this system allows the user to have a fully open window, a sheer covered window allowing light transmission with day time privacy, and a more opaque covering providing night time privacy or room darkening. In addition, it has intermediate light control of a louvered product like venetian blinds. The Colson window covering system is difficult to manufacture and to fabricate, has a limited range of fabrics it can use, and has a very flat appearance when in the light impeding mode. Another problem with this window covering is that a moire appearance often occurs on the front face of the window covering as a result of an alignment between the weave pattern of the front sheet and the weave pattern of the rear sheet. When this window covering is attached to a roller, the material tends to crumple or wrinkle when rolled up. The material is also hard to cut and the cut edges are difficult to seal because of the sheer fabrics that must be used.

Another light control window covering system is disclosed in U.S. Pat. No. 3,384,519 to Froget. The window covering disclosed there consists of two cloth layers spaced apart by movable parallel blades having each of their marginal edges heat welded to one of the movable cloth layers. Froget's welding uses the material present which is very thin in order to be see-through, flexible, and store well.

It is difficult to precisely apply heat and pressure to sufficiently bond these layers without damaging them by melting through the layer or forming warp spots. With this window covering relative movement of the two cloth layers in a direction perpendicular to the blades changes the angle of the blade and thus controls the amount of light emitted through the article. Because the blades must be heat welded to the cloth layers, only thermoplastic materials can be used. Also, heat welding necessarily requires a melting of some of the fibers of the material bonded, thus providing an uneven outer appearance along the heat welds and producing unwanted crimps or creases of the material which can result in fatigue failure. Furthermore, heat welding is a relatively slow process and the resulting weld is limited in strength. The window covering material in the Colson and Froget blinds is tilted and stored on a roller wrapping successively around itself. When the layer is displayed over the window the front layer is the same length as the back layer. When the layers are stored around the roller each layer travels a progressively larger or longer path, the difference depending on the thickness of each fabric. Since all the layers are bonded together the wrapping can cause wrinkling on the layers traveling on the inside or shorter paths. Having very uniformly thin layers helps mitigate this problem, but requiring thin layers limits the variations of the weave, yarns, style and other fabric features that can be chosen.

In my U.S. Pat. No. 5,339,882, I disclose a window covering having a series of slats connected between two spaced apart sheets of material. The slats are substantially perpendicular to the sheets of material when the covering is in an open position. The slats are substantially parallel to the first and second sheets of material when the window covering is in a closed position. This product has many of the same limitations of the window covering disclosed by Colson and Froget. All these products use sheets of fabric and have all the problems associated with fabric sheets.

In U.S. Pat. No. 5,753,338 Jelic et al. disclose a honeycomb material for window coverings in which the front face, back face and slats are interwoven simultaneously. This process uses an improved warp knitting technique in which a front mesh and a rear mesh are provided and warp threads are woven through them. The two meshes are maintained parallel to one another. At selected intervals slats are woven between the two meshes to form a honeycomb structure. Since the warp threads weave back and forth between meshes, it would seem almost impossible for the slat to have a greater density than the "faces." Secondly, since the material is created with the slats being perpendicular to the meshes, the slats must bend to affect the closure, but they have no hinge portion. This window covering has not been commercialized, but one would expect it to have the same problems as the window covering disclosed by Colson.

A problem with these fabric structures is that they must be very precisely made to look and function properly. But, textiles are inherently inconsistent and unprecise due to the nature of the weaving, printing and coating processes. Changes in temperature and humidity cause fabric to expand and contract. If a sheet of fabric is hung between a headrail and a bottomrail, a change in temperature or humidity may cause the edges of the fabric to move inward. Such movement is severely restrained near the headrail and the bottomrail, but can more easily occur around the center of the fabric. Consequently, the fabric sheet will assume an hourglass shape. For many fabrics this hourglass appearance is quite noticeable, particularly for longer shades. One way in which the art has been able to address this problem is to avoid using many fabrics for window coverings that will be subject to wide ranges of temperature and humidity. Some fabrics can be coated with starch or other chemicals to prevent shrinkage. But, that treatment increases costs.

There is a need for a window covering system which provides the light control of a venetian blind with the soft appearance of draperies and pleated shades. This window covering should be available in a wide variety of fabric, colors and styles. The window covering should not be adversely affected by changes in temperature and humidity. The window covering should be suitable for use on a roller or with lift cords to raise and lower the shade. The window covering should be able to be easily cut down from standard sizes and to be otherwise easy to fabricate. The system should be simple to install and to operate and able to be manufactured at a cost which allows the product to be sold at a competitive price. Furthermore, the window covering should not suffer from the moire effect that has plagued the window coverings which have two parallel sheets of light transmissive material. Finally, the widow covering should be easy to clean and maintain.

SUMMARY OF THE INVENTION

I provide a light controllable window covering in which there is a transparent front face formed from a series of spaced apart parallel threads. The back face is also transparent and can be made from knitted or woven material or could also be a series of spaced apart parallel thread. A series of opaque slats are attached between the two faces. The slats are preferably a knitted or woven fabric treated to have a given light impeding property. The front longitudinal edge of each slat is attached to the front face and the rear longitudinal edge of each slat is attached to the back face. The resulting structure when combined with a hardware system is a light control honeycomb window covering.

The parallel threads which form the front face are spaced apart from the back face an amount which allows light to readily pass while providing a soft fabric like appearance. Consequently, movement of the light impeding slats from a position perpendicular to the front face and back face to a position generally parallel to the front face and back face controls the amount of light which is admitted through the window covering.

The slats can be made from a single fabric which is woven or knitted or a nonwoven or a laminated combination that is flexible in at least the transverse direction. If desired the slats could also be a plastic, metal or even wood material. Longitudinal or transverse stiffeners may be provided on the slats.

The window covering made in this way can be attached to a roller or to a headrail and have lift cords routed through or adjacent the slats. A third layer of any type of material could be used with this window covering. That third layer could be adjacent the back face or the front face of the honeycomb structure. That layer could be raised and lowered independently or in conjunction with the other layers.

Other objects and advantages of the invention will become apparent from a description of certain present preferred embodiments shown in the drawings.

DESCRIPTION OF THE FIGURES

FIG. 3 is diagram showing a preferred method of making the embodiment of my light control window covering shown in FIGS. 1 and 2.

FIG. 7 is an end view of a fourth present preferred embodiment,

DESCRIPTION OF THE PREFERRED EMBODIMENTS

Figure 1:
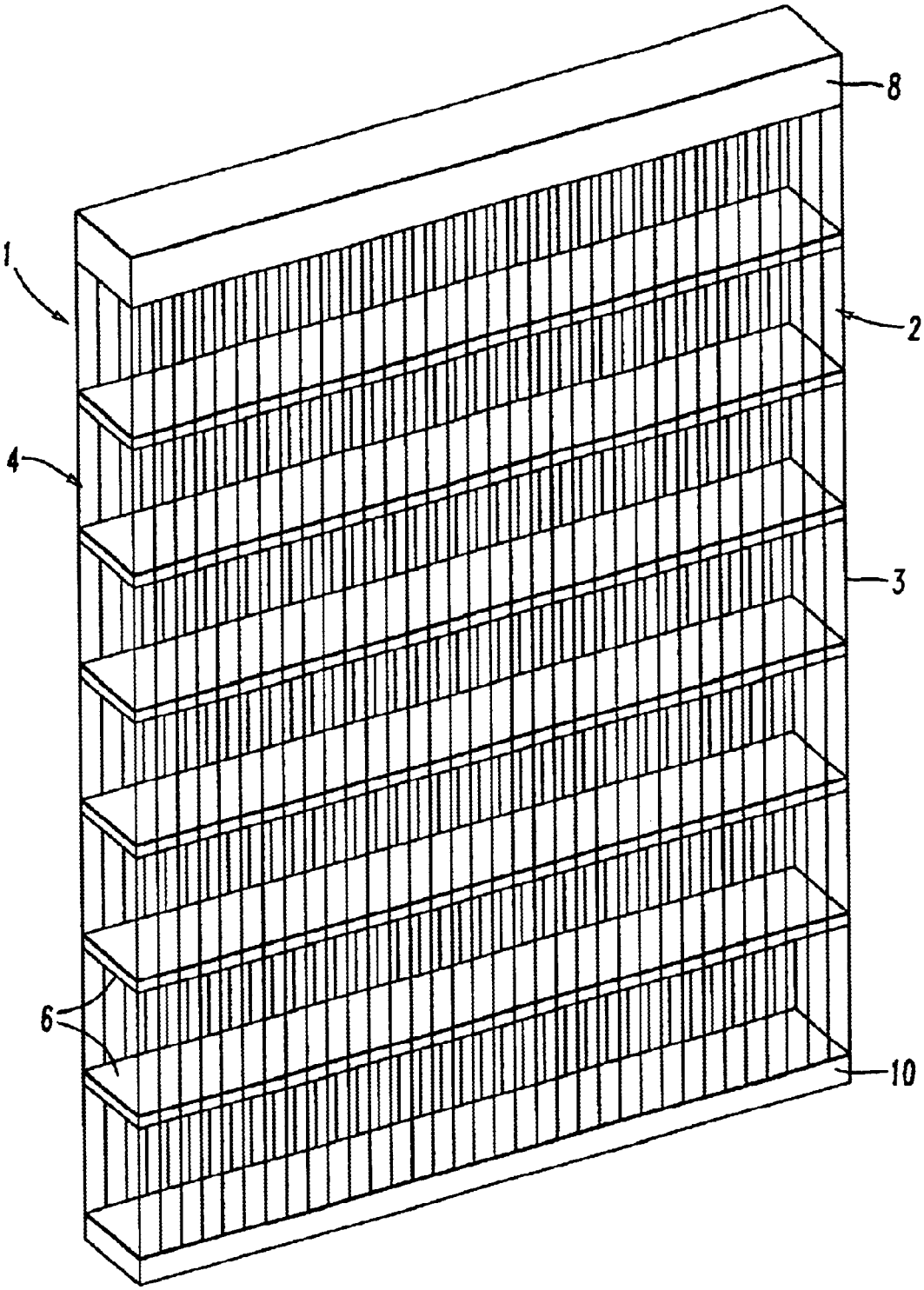
FIG. 1 is a perspective view of a first present preferred embodiment of my light control window covering in an open position.
Figure 2:
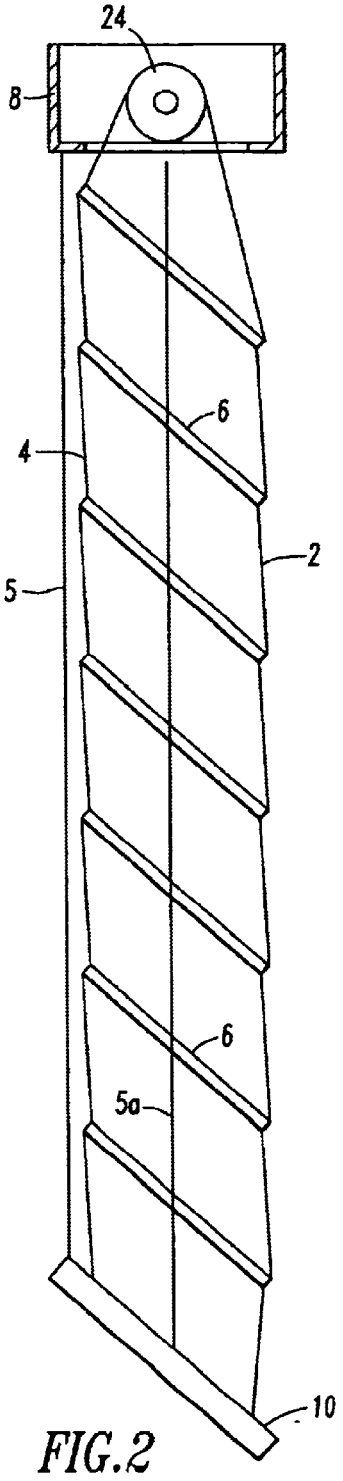
FIG. 2 is a side view of the window covering of FIG. 1 in a closed position.
Figure 8:
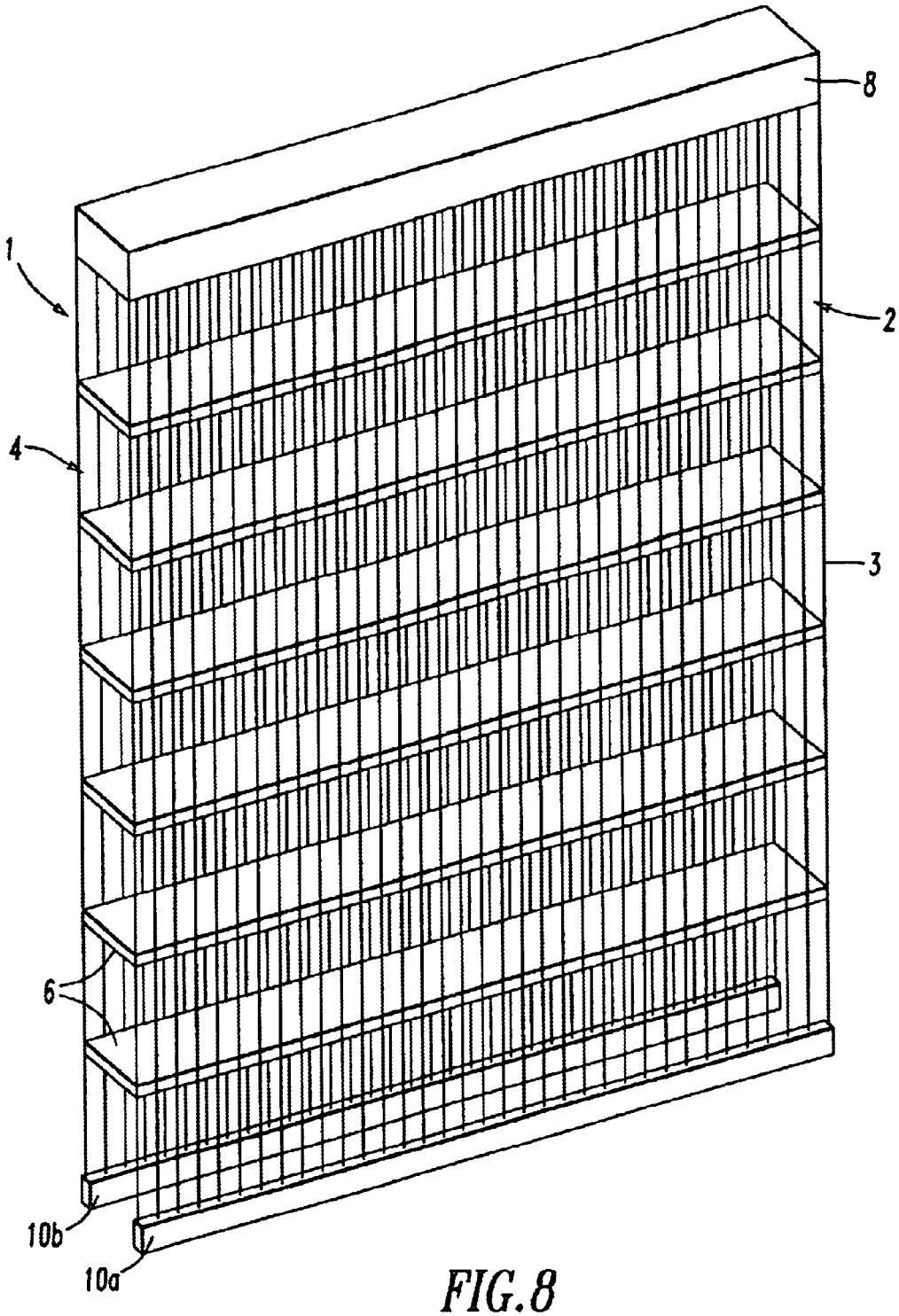
FIG. 8 is a perspective view of the embodiment shown in FIG. 1 modified so that the bottomrail is a first rail attached to the front face and a second rail attached to the back face.

A first present preferred embodiment of my light control window covering 1 shown in FIGS. 1 and 2 has a front face 2, a back face 4 and a series of slats 6 connected between them to form a honeycomb structure 1. The bottom rail 10 may be one piece, as shown in FIG. 1, or may consist of a first rail 10*a* attached to the front face and a second rail 10*b* attached to the back face, as shown in FIG. 8. The front and back faces extend from headrail 8 to bottomrail 10. In this embodiment, the front and back faces are a series of spaced apart parallel warp threads 3. There is a sufficient distance between adjacent threads to allow light to readily pass through the front and back faces. The spacing preferably is from 0.080 to 0.25 inches. However, to make the threads easily visible a greater spacing is shown in the figures. Using the warp threads alone for front and back faces minimizes the thickness of the structure when the honeycomb is in a closed position. This triple layer flattened honeycomb structure can be flattened to a theoretical minimum. Another advantage to using only warp threads, or using warp threads with relatively few weft treads, is that the warp threads can move toward and away from one another into the space between adjacent threads. Consequently, the threads can assume a sine wave shape when the window covering is rolled onto a roller. In this way the layer can shorten as needed to avoid wrinkling. A knit or woven fabric cannot do this. Use of parallel threads also increases transparency so that another more decorative, layer that may not be connected to the other layers can be placed on the front. Yet, another advantage of a parallel thread layer is that the slats can more easily be cleaned. A vacuum brush run over the face of the window covering can pull dust or bugs from the slats, between the parallel threads and into the vacuum cleaner.

Many of these same advantages can be obtained when one of the two layers is a knit or woven material. Consequently, in another embodiment of the present window covering, either the front face 2 or the back face 4 may be knit or woven material which permits passage of light through the material. A series of slats which are opaque or nearly opaque are attached to either or both of the front and back faces by adhesives or welding using any conventional attachment method. Slats could be lace or could be sheer with the intention of putting ribbons on top of the slats. These louvers enable the user to have a variable range of light pass through the window covering. The upper end of the range may just be a translucent level of light or it might be a black out. In most embodiments the slats likely will be semi-opaque.

As shown in FIG. 3 I prefer to form the honeycomb structure in manner similar to the process disclosed by Froget in U.S. Pat. No. 3,384,519. Two supply rolls 11 and 12 are provided. One roll 11 contains a series of threads, 3 each thread wound in a separate coil on the roll 13. The second supply roll 12 may be identical to the first roll 10 or it may be a knit fabric 14 or woven material wound on a roller. A series of slats 6 are placed on the advancing fabric 14 from supply 17. The slats are made of a flexible material or have a flexible or hinged edge. One edge of each slat is bonded to the fabric 14. The opposite edge of the slats is bonded to the parallel threads. In a preferred embodiment the slats 6 are first attached to the fabric 14. A glue line 15 is placed on the edge of the slat which is away from the fabric. The parallel threads 3 are fed over a grooved roller 16. Then the parallel threads 3, fabric 14 and slats are passed between rollers 17 and 18 where the threads 3 are attached to the slats. In one embodiment the adhesive 15 is melted by heated rollers 17 and 18. In another embodiment a two part adhesive is used. One part forms the glue line 15 and the other part is applied to the threads. Glue line 15 need not extend the full length of the slats, but could be a series of spaced apart droplets or short lines of adhesive. Thermoplastic ribs can be added to the edges of the slats to increase the amount of material available for welding onto the warps and also to enhance the rigidity of the slats on the edges so that there can be a longer span between warp threads. Such ribs will prevent the hour glass stretching of the product. Transverse stiffeners could also be provided on the slats.

The threads which form the front and back faces preferably will be a polyester but can be any type of thread that has been used in window covering fabrics. The slat also should be a polyester but other materials, such as polyester films and laminates that can be used. Another option is to use a copolyester hot melt adhesive which is tacky at a lower temperature, typically around 220° F., and melts and flows at a higher temperature, usually around 350° F. While the adhesive is tacky the slats can be easily positioned. When properly positioned the temperature can be raised to melt the adhesive and then quickly cooled to complete the bond.

The honeycomb structure could be attached to the bottom of the headrail in the same manner as are many conventional pleated shades. One option is to provide a mandrel 24 within the headrail. The front and back faces are oppositely connected to the mandrel 24. Rotation of the mandrel in either direction will move the back face relative to the front face tilting the slats. In this manner the orientation of the light impeding slats are moved from a position perpendicular to the front and back faces as shown in FIG. 1 to a position nearly parallel to the front and back faces such as is shown in FIG. 2. Lift cords 5 preferably extend from the bottomrail 10 into the headrail 8. A lift mechanism (not shown) within the headrail raises and lowers the window covering. The lift cords 5 can be placed only along the back of the window covering as shown in FIG. 2, along both the front and the back, or as shown by chain line 5*a* through apertures in the slats. In an alternative configuration the window covering could be rolled onto the mandrel to raise the window covering from a lowered to a raised position. When the shade is fully lowered rotating the mandrel will move the slats from a horizontal, open position toward a vertical closed position.

Figure 4:
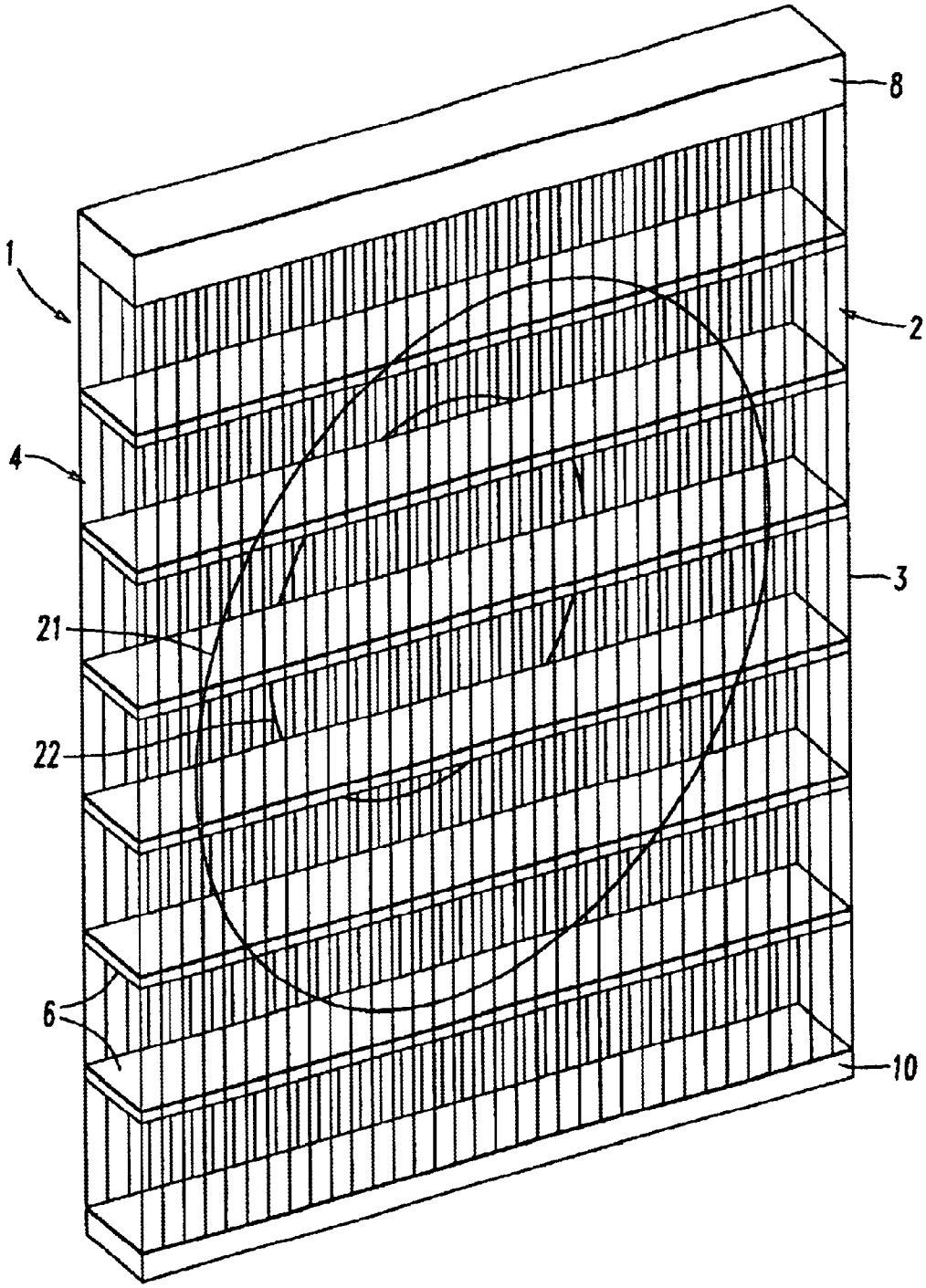
FIG. 4 is a front view of a second present preferred embodiment.

The use of parallel threads in the front face and the back face prevent the appearance of a moire pattern which is caused by a misalignment of two sheets of light transmissive fabric having the same or similar weave. If desired one could provide a series of widely spaced apart cross threads or weave threads through the parallel threads 3 to create a pleasing design or pattern such as large circle 11 in the front face and smaller circle 12 in the back face as shown in FIG. 4. However, these cross threads must not be so frequent as to create a woven material. Indeed, the number of cross threads should never be more than one-tenth of the number of parallel threads. A single thread which crosses back and forth across the parallel warp threads would be considered as a separate cross thread each time that it crosses the warp threads. If a large number of cross threads are provided in both the front face and the back face, then there likely will be the moire effect that this window covering is designed to avoid. Cross threads affect the cutting for width, the rolling on the roller, the transparency, the moire, but mostly the manufacturability of the product since knitted goods lack dimensional consistency as do woven sheers in wide widths. It is less costly saving machine time and material by not having cross threads.

Figure 5:
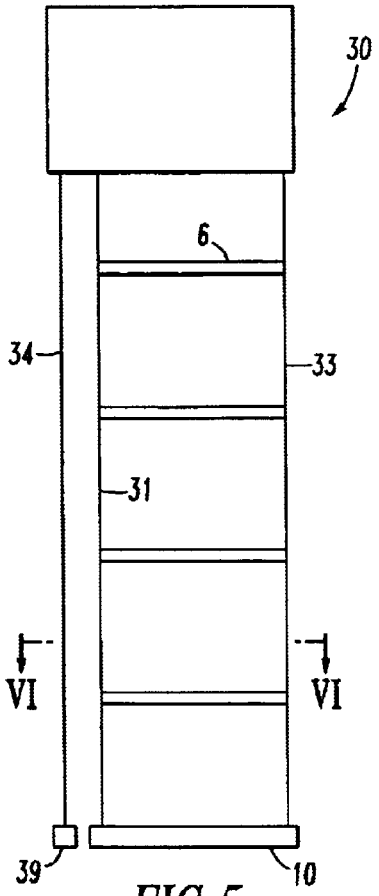
FIG. 5 is an end view of a third present preferred embodiment.
Figure 6:
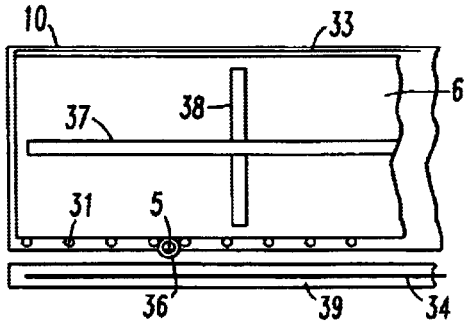
FIG. 6 is a sectional view taken along the line VI—VI of FIG. 5.

A third embodiment of the window covering 30 shown in FIGS. 5 and 6 has a honeycomb structure 32 similar to the previous embodiments and an additional layer 34 with bottomrail 39. The layer 34 in this embodiment is independent from the cellular structure 32. Layer 34 can be a pleated shade, a roman shade or a sheet of material wound on an independent roller. Preferably the independent roller 34 is adjacent the front of the cellular structure 32 and is a knit or lace material. The front 31 of the cellular structure is a series of parallel warp threads and the back 33 is a knit material or a series of parallel warp threads. The lift cords are positioned in spaces between adjacent parallel warp threads in the front face. Loops 36 are provided on the slats 3 for each lift cord. Stiffeners 37 and 38 may also be provided on each slat.

A fourth embodiment 40 as shown in FIG. 7 is similar to the third embodiment. This window covering 40 has a cellular structure 42 and additional layer 44. In this embodiment lift cords 45 run from the bottomrail 36 of the cellular structure. The additional layer 44 has tabs or loops through which the lift cords 45 pass. Consequently, raising the cellular structure 42 also raises the additional layer 44.

Use of the additional layer provides several advantages. Any material suitable for use in a window covering could be used for the additional layer. Consequently, the front layer could be any color or texture and have any weave or pattern. This is possible because the additional layer is not part of the multi-layer cellular structure and is not bonded to any other material. In a multi-layer cellular material one's choice of materials is limited by fabrication concerns and compatibility of fabrics. The material for the front layer must not stretch much more or less than the material selected for the back layer or wrinkling will occur. Some materials are difficult to bond to other materials. Cost is always a concern. In the present preferred embodiments the cellular structures can be made of a relatively inexpensive material while the additional layer can be more expensive fabric.

In all the embodiments one can clean slats through the front face of parallel warp threads. Any additional layer could easily be lifted or rolled-up to allow access through the layer of parallel warp threads. The present invention minimizes thickness of front and back faces that are attached to the slats, minimizes visual contributions of faces and increases transparency. In the present window covering the slat is a more dominant visual component for color and texture. The faces of the cellular structure are so thin, inexpensive and transparent that an additional layer of decorative material can be added in the front. It is also easier to cut across the width of a layer without fraying or welding adjacent layers.

In describing the preferred embodiments the terms front face and back face have been used to distinguish the faces of the cellular structure. It should be understood that when the cellular structure is attached to the headrail or placed over a window opening, either face may be facing the window. Consequently, front face is not limited to the room side of the window covering and back face is not limited to the side of the window covering nearest the window.

Although I have shown several present preferred embodiments of my window covering, it should be distinctly understood that the invention is not limited thereto but may be variously embodied within the scope of the following claims.

I claim:

1. A honeycomb comprised of a front face, a back face and a plurality of slats attached therebetween wherein:

the front face is comprised of a fabric having parallel threads spaced apart a sufficient amount so as to allow light to pass through the front face, the front face having no cross threads intersecting the parallel threads;

the back face is comprised of a fabric having parallel threads spaced apart a sufficient amount so as to allow light to pass through the front face; and the slats are comprised of a material that is opaque or nearly opaque.

2. The honeycomb of claim 1 also comprising cross threads in the back face.

3. The honeycomb of claim 2 wherein the cross threads and the spaced apart parallel threads form a knit material or a woven material.

4. The honeycomb of claim 1 wherein the material of the slats are selected from the group consisting of wood, metal, plastic, textile and composite materials.

5. The honeycomb of claim 1 wherein the slats are comprised of a flexible material.

6. The honeycomb of claim 1 wherein the slats are comprised of a rigid material.

7. The honeycomb of claim 1 also comprising at least one stiffener attached to at least one of the slats, the at least one stiffener being a longitudinal stiffener or a transverse stiffener.

8. The honeycomb of claim 1 also comprising at least one of a headrail, a bottomrail and a roller attached to the front face and the back face to form one of a horizontal shade, and a roller shade.

9. The honeycomb of claim 1 also comprising at least one lift cord routed through the honeycomb.

10. The honeycomb of claim 9 wherein the at least one lift cord is positioned within a space between two adjacent parallel threads in one of the front face and the back face.

11. The honeycomb of claim 9 also comprising a loop attached to each slat for each of the at least one lift cord and that lift cord passes through each such loop.

12. The honeycomb of claim 1 also comprising at least one cross thread woven through the parallel spaced threads in the front face, the number of cross threads being not more than one tenth as many as the plurality of parallel threads in the front face.

13. The honeycomb of claim 12 wherein the at least one cross thread forms a decorative pattern.

14. The honeycomb of claim 1 wherein the slats have been attached to at least one of the front face and the back face at spaced apart locations on each slat.

15. The honeycomb of claim 1 also comprising at least one cross thread woven through the parallel spaced threads of the back face, the number of cross threads being not more than one tenth as many as the plurality of parallel threads in the back face.

16. The honeycomb of claim 1 wherein the plurality of parallel threads in the front face are spaced apart a distance from 0.08 inches to 0.25 inches.

17. The honeycomb of claim 1 wherein the plurality of parallel threads in the back face are spaced apart a distance from 0.08 inches to 0.25 inches.

18. The honeycomb of claim 1 also comprising a mandrel to which the front face and the back face are attached.

19. The honeycomb of claim 1 also comprising:

a. a headrail attached to the honeycomb at one end;

b. a bottomrail attached to the honeycomb at an opposite end; and c. at least one lift cord extending from the bottomrail into the headrail.

20. The honeycomb of claim 19 wherein the bottomrail is comprised of a first rail attached to the front face and a second rail attached to the back face.

21. The honeycomb of claim 19 also comprising at layer of material extending from the headrail and positioned opposite one of the front face and the rear face.

22. The honeycomb of claim 21 wherein the layer of material is connected to the at least one lift cord.

23. The honeycomb of claim 21 also comprising at least one additional lift cord attached to the layer of material and extending from the headrail.

24. The honeycomb material of claim 21 also comprising a second bottomrail attached to the layer of material.

* * * * *